US006641916B1

(12) United States Patent
Chang et al.

(10) Patent No.: US 6,641,916 B1
(45) Date of Patent: Nov. 4, 2003

(54) POLY(TRIMETHYLENE TEREPHTHALATE) BICOMPONENT FIBERS

(75) Inventors: Jing C. Chang, Boothwyn, PA (US); Joseph V. Kurian, Hockessin, DE (US); Ray W. Miller, Kennett Square, PA (US)

(73) Assignee: E. I. Du Pont De Nemours and Company, Wilmington, DE (US)

( * ) Notice: Subject to any disclaimer, the term of this patent is extended or adjusted under 35 U.S.C. 154(b) by 0 days.

(21) Appl. No.: 10/287,975

(22) Filed: Nov. 5, 2002

(51) Int. Cl.[7] ..... D01F 8/00

(52) U.S. Cl. ..... 428/373; 428/374; 428/372; 428/370; 525/177

(58) Field of Search ..... 428/373, 374, 428/370, 372; 525/177

(56) References Cited

U.S. PATENT DOCUMENTS

| | | | |
|---|---|---|---|
| 3,454,460 | A | 7/1969 | Bosley |
| 3,671,379 | A | 6/1972 | Evans et al. |
| 4,410,473 | A | 10/1983 | Iohara et al. |
| 4,454,196 | A | 6/1984 | Iohara et al. |
| 5,340,909 | A | 8/1994 | Doerr et al. |
| 5,798,433 | A | 8/1998 | Schmidt et al. |
| 6,245,844 | B1 | 6/2001 | Kurian et al. |
| 6,312,805 | B1 | 11/2001 | Sun |

FOREIGN PATENT DOCUMENTS

| | | | |
|---|---|---|---|
| EP | 0 699 700 | B1 | 6/1996 |
| EP | 0 847 960 | A1 | 6/1999 |
| JP | 56-091013 | | 7/1981 |
| JP | 11-189925 | | 7/1999 |
| JP | 2002-56918 | A | 9/2000 |
| WO | WO 00/26301 | | 11/2000 |
| WO | WO 01/34693 | A2 | 5/2001 |
| WO | WO 01/53573 | A1 | 7/2001 |
| WO | WO 02/086211 | A1 | 10/2002 |

OTHER PUBLICATIONS

U.S. patent application No. 09/708,209, filed Nov. 8, 2000.
U.S. patent application No. 10/183,710, filed Jun. 27, 2002.
U.S. patent application No. 09/938,760, filed Aug. 24, 2002.

*Primary Examiner*—N. Edwards
(74) *Attorney, Agent, or Firm*—Mark D. Kuller

(57) ABSTRACT

A side-by-side or eccentric sheath-core bicomponent fiber wherein each component comprises a different poly (trimethylene terephthalate) composition and wherein at least one of the compositions comprises styrene polymer dispersed throughout the poly(trimethylene terephthalate), and preparation and use thereof.

14 Claims, 3 Drawing Sheets

POLY(TRIMETHYLENE TEREPHTHALATE) BICOMPONENT FIBERS

FIELD OF THE INVENTION

This invention relates to bicomponent poly(trimethylene terephthalate) fibers and processes for the manufacture thereof.

BACKGROUND OF THE INVENTION

Poly(trimethylene terephthalate) (also referred to as "3GT" or "PTT")has recently received much attention as a polymer for use in textiles, flooring, packaging and other end uses. Textile and flooring fibers have excellent physical and chemical properties.

It is known that bicomponent fibers wherein the two components have differing degrees of orientation, as indicated by differing intrinsic viscosities, possess desirable crimp contraction properties which lead to increased value in use for said fibers.

U.S. Pat. Nos. 3,454,460 and 3,671,379 disclose bicomponent polyester textile fibers. Neither reference discloses bicomponent fibers, such as sheath-core or side-by-side fibers, wherein each of the two components comprises the same polymer, e.g. poly(trimethylene terephthalate), differing in physical properties.

WO 01/53573 A1 discloses a spinning process for the production of side-by-side or eccentric sheath-core bicomponent fibers, the two components comprising poly(ethylene terephthalate) and poly(trimethylene terephthalate), respectively. Due to the poly(ethylene terephthalate) fibers and fabrics made from them have a harsher hand than poly (trimethylene terephthalate) monocomponent fibers and fabrics. In addition, due to the poly(ethylene terephthalate) these fibers and their fabrics require high-pressure dyeing.

U.S. Pat. Nos. 4,454,196 and 4,410,473, which are incorporated herein by reference, describe a polyester multifilament yarn consisting essentially of filament groups (I) and (II). Filament group (I) is composed of polyester selected from the group poly(ethylene terephthalate), poly (trimethylene terephthalate) and poly(tetramethylene terephthalate), and/or a blend and/or copolymer comprising at least two members selected from these polyesters. Filament group (II) is composed of a substrate composed of (a) a polyester selected from the group poly(ethylene terephthalate), poly(trimethylene terephthalate) and poly (tetramethylene terephthalate), and/or a blend and/or copolymer comprising at least two members selected from these polyesters, and (b) 0.4 to 8 weight % of at least one polymer selected from the group consisting of styrene type polymers, methacrylate type polymers and acrylate type polymers. The filaments can be extruded from different spinnerets, but are preferably extruded from the same spinneret. It is preferred that the filaments be blended and then interlaced so as to intermingle them, and then subjected to drawing or draw-texturing. The Examples show preparation of filaments of type (II) from poly(ethylene terephthalate) and polymethylmethacrylate (Example 1) and polystyrene (Example 3), and poly(tetramethylene terephthalate) and polyethylacrylate (Example 4). Poly(trimethylene terephthalate) was not used in the examples. These disclosures of multifilament yams do not include a disclosure of multicomponent fibers.

JP 11-189925, describes the manufacture of sheath-core fibers comprising poly(trimethylene terephthalate) as the sheath component and a polymer blend comprising 0.1 to 10 weight %, based on the total weight of the fiber, polystyrene-based polymer as the core component. According to this application, processes to suppress molecular orientation using added low softening point polymers such as polystyrene did not work. (Reference is made to JP 56-091013 and other patent applications.) It states that the low melting point polymer present on the surface layer sometimes causes melt fusion when subjected to a treatment such as false-twisting (also known as "texturing"). Other problems mentioned included cloudiness, dye irregularities, blend irregularities and yam breakage. According to this application, the core contains polystyrene and the sheath does not. Example 1 describes preparation of a fiber with a sheath of poly (trimethylene terephthalate) and a core of a blend of polystyrene and poly(trimethylene terephthalate), with a total of 4.5% of polystyrene by weight of the fiber.

JP 2002-56918A discloses sheath-core or side-by-side bicomponent fibers wherein one side (A) comprises at least 85 mole % poly(trimethylene terephthalate) and the other side comprises (B) at least 85 mole % poly(trimethylene terephthalate) copolymerized with 0.05–0.20 mole % of a trifunctional comonomer; or the other side comprises (C) at least 85 mole % poly(trimethylene terephthalate) not copolymerized with a trifunctional comonomer wherein the inherent viscosity of (C) is 0.15 to 0.30 less than that of (A). It is disclosed that the bicomponent fibers obtained were pressure dyed at 130° C.

It is desired to prepare fibers which have excellent stretch, a soft hand and excellent dye uptake, and which can be spun at high-speeds and dyed under atmospheric pressure.

It is also desired to increase productivity in the manufacture of side-by-side or eccentric sheath core poly (trimethylene terephthalate) bicomponent fibers by using higher speed spinning process, without deterioration of the filament and yarn properties.

SUMMARY OF THE INVENTION

The invention is directed to a side-by-side or eccentric sheath-core bicomponent fiber wherein each component comprises poly(trimethylene terephthalate) differing in intrinsic viscosity (IV) by about 0.03 to about 0.5 dl/g and wherein at least one of the components comprises styrene polymer dispersed throughout the poly(trimethylene terephthalate).

The invention is also directed to a process for preparing poly(trimethylene terephthalate) side-by-side or eccentric sheath-core bicomponent fibers comprising (a) providing two different poly(trimethylene terephthalate)s differing in intrinsic viscosity (IV) by about 0.03 to about 0.5 dl/g, at least one of which contains styrene polymer, by weight of the polymers, and (b) spinning the poly(trimethylene terephthalate)s to form side-by-side or eccentric sheath-core bicomponent fibers wherein at least one of the component comprises the styrene polymer dispersed throughout the poly(trimethylene terephthalate). Preferably the bicomponent fibers are in the form of a partially oriented multifilament yarn.

The invention is further directed to a process for preparing poly(trimethylene terephthalate) bicomponent self-crimping yarn comprising poly(trimethylene terephthalate) bicomponent filaments, comprising (a) preparing the partially oriented poly(trimethylene terephthalate) multifilament yarn, (b) winding the partially oriented yam on a package, (c) unwinding the yarn from the package, (d) drawing the bicomponent filament yarn to form a drawn yarn, (e) annealing the drawn yarn, and (f) winding the yarn onto a package. In one preferred embodiment, the process comprises drawing, annealing and cutting the fibers into staple fibers.

In addition, the invention is directed to a process for preparing fully drawn yam comprising crimped poly (trimethylene terephthalate) bicomponent fibers, comprising the steps of:

(a) providing two different poly(trimethylene terephthalate)s differing in intrinsic viscosity (IV) by about 0.03 to about 0.5 dl/g, wherein at least one of the poly(trimethylene terephthalate)s comprises styrene polymer;

(b) melt-spinning the poly(trimethylene terephthalate)s from a spinneret to form at least one bicomponent fiber having either a side-by-side or eccentric sheath-core cross-section;

(c) passing the fiber through a quench zone below the spinneret;

(d) drawing the fiber, preferably at a temperature of about 50 to about 170° C. and preferably at a draw ratio of about 1.4 to about 4.5;

(e) heat-treating the drawn fiber, preferably at about 110 to about 170° C.;

(f) optionally interlacing the filaments; and (g) winding-up the filaments.

Further, the invention is directed to a process for preparing poly(trimethylene terephthalate) self-crimped bicomponent staple fiber comprising:

(a) providing two different poly(trimethylene terephthalate)s differing in intrinsic viscosity by about 0.03 to about 0.5 dl/g, wherein at least one of them comprises styrene polymer;

(b) melt-spinning the compositions through a spinneret to form at least one bicomponent fiber having either a side-by-side or eccentric sheath-core cross-section;

(c) passing the fiber through a quench zone below the spinneret;

(d) optionally winding the fibers or placing them in a can;

(e) drawing the fiber;

(f) heat-treating the drawn fiber; and (g) cutting the fibers into about 0.5 to about 6 inches staple fiber.

Preferably the poly(trimethylene terephthalate)s differ in IV by at least about 0.10 dl/g, and preferably up to about 0.3 dl/g.

Preferably the styrene polymer is selected from the group consisting of polystyrene, alkyl or aryl substituted polystyrenes and styrene multicomponent polymers, more preferably polystyrenes.

The styrene polymer is preferably present in a component in an amount of at least about 0.1%, more preferably at least about 0.5, and preferably up to about 10 weight %, more preferably up to about 5 weight %, and most preferably up to about 2 weight %, by weight of the polymers in the component.

In a preferred embodiment, the styrene polymer is present in each of the components.

In another preferred embodiment the styrene polymer is present in only one of the components. In one preferred embodiment the styrene polymer is in the component with the higher IV poly(trimethylene terephthalate). In a second preferred embodiment the styrene polymer is in the component with the lower IV poly(trimethylene terephthalate).

Preferably each component comprises at least about 95% of poly(trimethylene terephthalate), by weight of the polymer in the component.

Preferably each of the poly(trimethylene terephthalate)s contains at least 95 mole % trimethylene terephthalate repeat units.

Advantages of the invention over fibers and fabrics made from poly(trimethylene terephthalate) and poly(ethylene terephthalate) include softer hand, higher dye-uptake, and the ability to dye under atmospheric pressure.

When the styrene polymer is in the higher IV poly (trimethylene terephthalate) (including when it is in both poly(trimethylene terephthalates), the fibers of this invention can be prepared using higher spinning speeds, higher drawing speeds and higher draw ratios than other poly (trimethylene terephthalate) bicomponent fibers.

When styrene polymer is added to the lower IV poly (trimethylene terephthalate) or to the lower IV poly (trimethylene terephthalate) in greater amount than the higher IV poly(trimethylene terephthalate), the differences between the molecular orientation of the poly(trimethylene terephthalate)s will increase, and crimp contraction and stretch increases.

By varying the amount of polystyrene in each side (or section), or only adding it in one side (or section), it is possible to further control the crimp level and stretch.

DETAILED DESCRIPTION OF THE INVENTION

Figure 1:
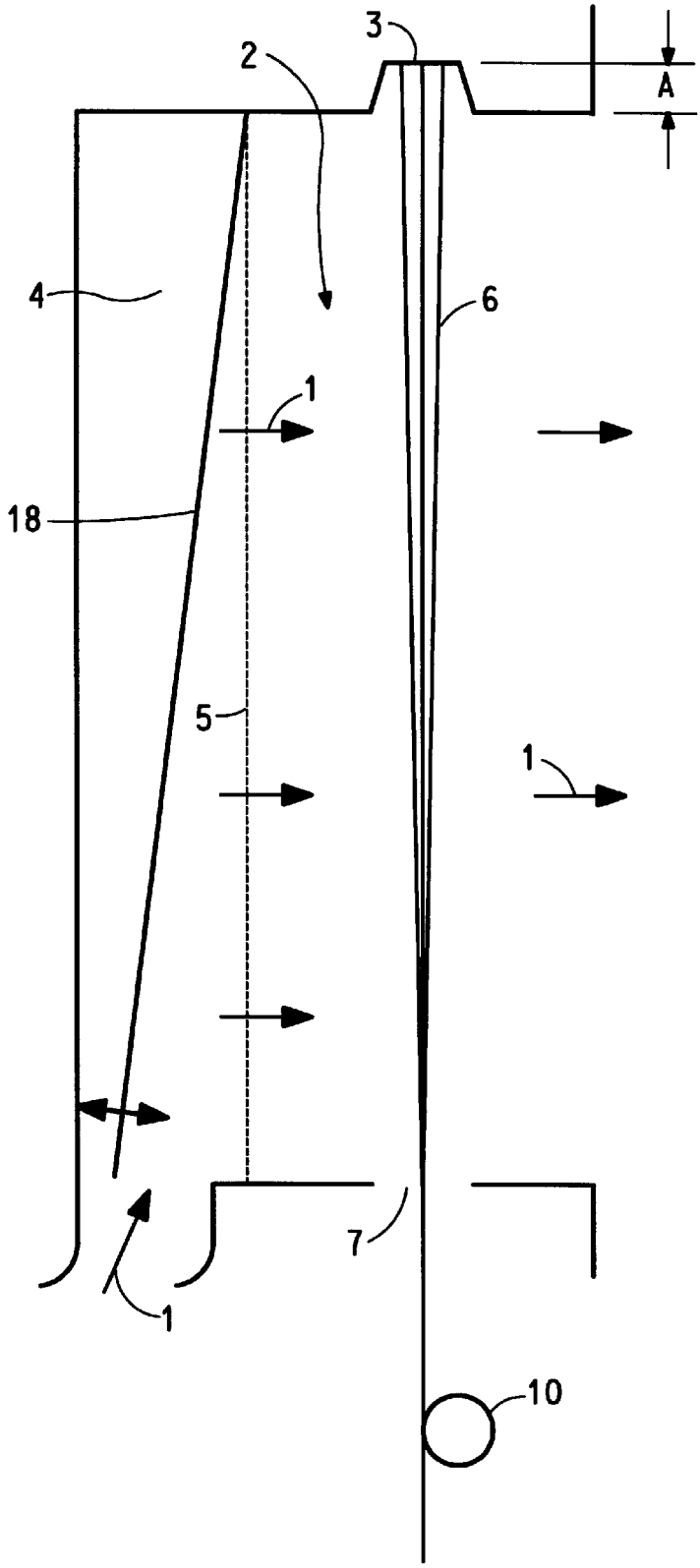
FIG. 1 illustrates a cross-flow quench melt-spinning apparatus useful in the preparation of the products of the present invention.

As used herein, "bicomponent fiber" means a fiber comprising a pair of polymers intimately adhered to each other along the length of the fiber, so that the fiber cross-section is for example a side-by-side, eccentric sheath-core or other suitable cross-sections from which useful crimp can be developed.

In the absence of an indication to the contrary, a reference to "poly(trimethylene terephthalate)" ("3GT" or "PTT"), is meant to encompass homopolymers and copolymers containing at least 70 mole % trimethylene terephthalate repeat units and polymer compositions containing at least 70 mole % of the homopolymers or copolyesters. The preferred poly(trimethylene terephthalate)s contain at least 85 mole %, more preferably at least 90 mole %, even more preferably at least 95 or at least 98 mole %, and most preferably about 100 mole %, trimethylene terephthalate repeat units.

Examples of copolymers include copolyesters made using 3 or more reactants, each having two ester forming groups. For example, a copoly(trimethylene terephthalate) can be used in which the comonomer used to make the copolyester is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclohexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 2–8 carbon atoms (other than 1,3-propanediol, for example, ethanediol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and aromatic ether glycols having 4–10 carbon atoms (for example, hydroquinone bis(2-hydroxyethyl) ether, or a poly (ethylene ether) glycol having a molecular weight below about 460, including diethyleneether glycol). The comonomer typically is present in the copolyester at a level in the range of about 0.5 to about 15 mole %, and can be present in amounts up to 30 mole %.

The poly(trimethylene terephthalate) can contain minor amounts of other comonomers, and such comonomers are usually selected so that they do not have a significant adverse effect on properties. Such other comonomers include 5-sodium-sulfoisophthalate, for example, at a level in the range of about 0.2 to 5 mole %. Very small amounts of trifunctional comonomers, for example trimellitic acid, can be incorporated for viscosity control.

The poly(trimethylene terephthalate) can be blended with up to 30 mole percent of other polymers. Examples are polyesters prepared from other diols, such as those described above. The preferred poly(trimethylene terephthalate)s contain at least 85 mole %, more preferably at least 90 mole %, even more preferably at least 95 or at least 98 mole %, and most preferably about 100 mole %, poly(trimethylene terephthalate).

The intrinsic viscosity of the poly(trimethylene terephthalate) used in the invention ranges from about 0.60 dl/g up to about 2.0 dl/g, more preferably up to 1.5 dl/g, and most preferably up to about 1.2 dl/g. Preferably the poly (trimethylene terephthalates) have a difference in IV of about 0.03 more preferably at least about 0.10 dl/g, and preferably up to about 0.5 dl/g, more preferably up to about 0.3 dl/g.

Poly(trimethylene terephthalate) and preferred manufacturing techniques for making poly(trimethylene terephthalate) are described in U.S. Pat. Nos. 5,015,789, 5,276,201, 5,284,979, 5,334,778, 5,364,984, 5,364,987, 5,391,263, 5,434,239, 5,510454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745, 5,990,265, 6,235,948, 6,245,844, 6,255,442, 6,277,289, 6,281,325, 6,312,805, 6,325,945, 6,331,264, 6,335,421, 6,350,895, and 6,353,062, EP 998 440, WO 00/14041 and 98/57913, H. L. Traub, "Synthese und textilchemische Eigenschaften des Poly-Trimethyleneterephthalats", Dissertation Universitat Stuttgart (1994), S. Schauhoff, "New Developments in the Production of Poly(trimethylene terephthalate) (PTT)", Man-Made Fiber Year Book (September 1996), and U.S. patent application Ser. No. 10/057,497, all of which are incorporated herein by reference. Poly(trimethylene terephthalate)s useful as the polyester of this invention are commercially available from E. I. du Pont de Nemours and Company, Wilmington, Del., under the trademark Sorona.

By "styrene polymer" is meant polystyrene and its derivatives. Preferably the styrene polymer is selected from the group consisting of polystyrene, alkyl or aryl substituted polystyrenes and styrene multicomponent polymers. Here, "multicomponent" includes copolymers, terpolymers, tetrapolymers, etc., and blends.

More preferably the styrene polymer is selected from the group consisting of polystyrene, alkyl or aryl substituted polystyrenes prepared from α-methylstyrene, p-methoxystyrene, vinyltoluene, halostyrene and dihalostyrene (preferably chlorostyrene and dichlorostyrene), styrene-butadiene copolymers and blends, styrene-acrylonitrile copolymers and blends, styrene-acrylonitrile-butadiene terpolymers and blends, styrene-butadiene-styrene terpolymers and blends, styrene-isoprene copolymers, terpolymers and blends, and blends and mixtures thereof. Even more preferably, the styrene polymer is selected from the group consisting of polystyrene, methyl, ethyl, propyl, methoxy, ethoxy, propoxy and chloro-substituted polystyrene, or styrene-butadiene copolymer, and blends and mixtures thereof. Yet more preferably, the styrene polymer is selected from the group consisting of polystyrene, α-methyl-polystyrene, and styrene-butadiene copolymers and blends thereof. Most preferably, the styrene polymer is polystyrene.

The number average molecular weight of the styrene polymer is at least about 5,000, preferably at least 50,000, more preferably at least about 75,000, even more preferably at least about 100,000 and most preferably at least about 120,000. The number average molecular weight of the styrene polymer is preferably up to about 300,000, more preferably up to about 200,000 and most preferably up to about 150,000.

Useful polystyrenes can be isotactic, atactic, or syndiotactic, and with high molecular weight polystyrenes atactic is preferred. Styrene polymers useful in this invention are commercially available from many suppliers including Dow Chemical Co. (Midland, Mich.), BASF (Mount Olive, N.J.) and Sigma-Aldrich (Saint Louis, Mo).

Poly(trimethylene terephthalate)s can be prepared using a number of techniques. Preferably poly(trimethylene terephthalate) and the styrene polymer are melt blended and, then, extruded and cut into pellets. ("Pellets" is used generically in this regard, and is used regardless of shape so that it is used to include products sometimes called "chips", "flakes", etc.) The pellets are then remelted and extruded into filaments. The term "mixture" is used when specifically referring to the pellets prior remelting and the term "blend" is used when referring to the molten composition (e.g., after remelting). A blend can also be prepared by compounding poly(trimethylene terephthalate) pellets with polystyrene during remelting, or by otherwise feeding molten poly (trimethylene terephthalate) and mixing it with styrene polymer prior to spinning.

The poly(trimethylene terephthalate)s preferably comprise at least about 70%, more preferably at least about 80%, even more preferably at least 85%, more preferably at least about 90%, most preferably at least about 95%, and in some cases even more preferably at least 98% of poly (trimethylene terephthalate), by weight of the polymers in the component. The poly(trimethylene terephthalate) preferably contains up to about 100 weight % of poly (trimethylene terephthalate), or 100 weight % minus the amount of styrene polymer present.

The poly(trimethylene terephthalate) composition preferably comprises at least about 0.1%, more preferably at least about 0.5%, of styrene polymer, by weight of the polymer in a component. The composition preferably comprises up to about 10%, more preferably up to about 5%, even more preferably up to about 3%, even more preferably up to 2%, and most preferably up to about 1.5%, of a styrene polymer, by weight of the polymer in the component. In many instances, preferred is about 0.8% to about 1% styrene polymer. Reference to styrene polymer means at least one styrene polymer, as two or more styrene polymers can be used, and the amount referred to is an indication of the total amount of styrene polymer(s) used in the polymer composition.

The poly(trimethylene terephthalate) can also be an acid-dyeable polyester composition as described in U.S. pat. application Ser. Nos. 09/708,209, filed Nov. 8, 2000 (corresponding to WO 01/34693) or Ser. No. 09/938,760, filed Aug. 24, 2002, both of which are incorporated herein by reference. The poly(trimethylene terephthalate)s of U.S. patent application No. 09/708,209 comprise a secondary amine or secondary amine salt in an amount effective to promote acid-dyeability of the acid dyeable and acid dyed polyester compositions. Preferably, the secondary amine unit is present in the composition in an amount of at least about 0.5 mole %, more preferably at least 1 mole %. The secondary amine unit is present in the polymer composition in an amount preferably of about 15 mole % or less, more preferably about 10 mole % or less, and most preferably 5 mole % or less, based on the weight of the composition. The acid-dyeable poly(trimethylene terephthalate) compositions of U.S. patent application Ser. No. 09/938,760 comprise poly(trimethylene terephthalate) and a polymeric additive based on a tertiary amine. The polymeric additive is prepared from (i) triamine containing secondary amine or secondary amine salt unit(s) and (ii) one or more other monomer and/or polymer units. One preferred polymeric additive comprises polyamide selected from the group consisting of poly-imino-bisalkylene-terephthalamide, -isophthalamide and -1,6-naphthalamide, and salts thereof. The poly(trimethylene terephthalate) useful in this invention can also be cationically dyeable or dyed composition such as those described in U.S. patent No. 6,312,805, which is incorporated herein by reference, and dyed or dye-containing compositions.

Other polymeric additives can be added to the poly (trimethylene terephthalate), styrene polymer, etc., to improve strength, to facilitate post extrusion processing or provide other benefits. For example, hexamethylene diamine can be added in minor amounts of about 0.5 to about 5 mole % to add strength and processability to the acid dyeable polyester compositions of the invention. Polyamides such as nylon 6 or nylon 6—6 can be added in minor amounts of about 0.5 to about 5 mole % to add strength and processability to the acid-dyeable polyester compositions of the invention. A nucleating agent, preferably 0.005 to 2 weight % of a mono-sodium salt of a dicarboxylic acid selected from the group consisting of monosodium terephthalate, mono sodium naphthalene dicarboxylate and mono sodium isophthalate, as a nucleating agent, can be added as described in U.S. Pat. No. 6,245,844, which is incorporated herein by reference.

The poly(trimethylene terephthalate) and styrene polymer can, if desired, contain additives, e.g., delusterants, nucleating agents, heat stabilizers, viscosity boosters, optical brighteners, pigments, and antioxidants. $TiO_2$ or other pigments can be added to the poly(trimethylene terephthalate), the composition, or in fiber manufacture. (See, e.g., U.S. Pat. Nos. 3,671,379, 5,798,433 and 5,340,909, EP 699 700 and 847 960, and WO 00/26301, which are incorporated herein by reference.) The poly(trimethylene terephthalate) can be provided by any known technique, including physical blends and melt blends. Preferably the poly(trimethylene terephthalate) and styrene polymer are melt blended and compounded. More specifically, poly(trimethylene terephthalate) and styrene polymer are mixed and heated at a temperature sufficient to form a blend, and upon cooling, the blend is formed into a shaped article, such as pellets. The poly(trimethylene terephthalate) and polystyrene can be formed into a composition in many different ways. For instance, they can be (a) heated and mixed simultaneously, (b) pre-mixed in a separate apparatus before heating, or (c) heated and then mixed, for example by transfer line injection. The mixing, heating and forming can be carried out by conventional equipment designed for that purpose such as extruders, Banbury mixers or the like. The temperature should be above the melting points of each component but below the lowest decomposition temperature, and accordingly must be adjusted for any particular composition of poly(trimethylene terephthalate) and styrene polymer. Temperature is typically in the range of about 200° C. to about 270° C., most preferably at least about 250° C. and preferably up to about 260° C., depending on the particular styrene polymer of the invention.

The styrene polymer is highly dispersed throughout the poly(trimethylene terephthalate). Preferably, the dispersed styrene polymer has a mean cross-sectional size of less than about 1,000 nm, more preferably less than about 500 nm, even more preferably less than about 200 nm and most preferably less than about 100 nm, and the cross-section can be as small as about 1 nm. By "cross-sectional size", reference is made to the size when measured from a radial image of a filament.

FIG. 1 illustrates a crossflow melt-spinning apparatus which is useful in the process of the invention. Quench gas 1 enters zone 2 below spinneret face 3 through plenum 4, past hinged baffle 18 and through screens 5, resulting in a substantially laminar gas flow across still-molten fibers 6 which have just been spun from capillaries (not shown) in the spinneret. Baffle 18 is hinged at the top, and its position can be adjusted to change the flow of quench gas across zone 2. Spinneret face 3 is recessed above the top of zone 2 by distance A, so that the quench gas does not contact the just-spun fibers until after a delay during which the fibers may be heated by the sides of the recess. Alternatively, if the spinneret face is not recessed, an unheated quench delay space can be created by positioning a short cylinder (not shown) immediately below and coaxial with the spinneret face. The quench gas, which can be heated if desired, continues on past the fibers and into the space surrounding the apparatus. Only a small amount of gas can be entrained by the moving fibers which leave zone 2 through fiber exit 7. Finish can be applied to the now-solid fibers by optional finish roll 10, and the fibers can then be passed to the rolls illustrated in FIG. 2.

Figure 2:
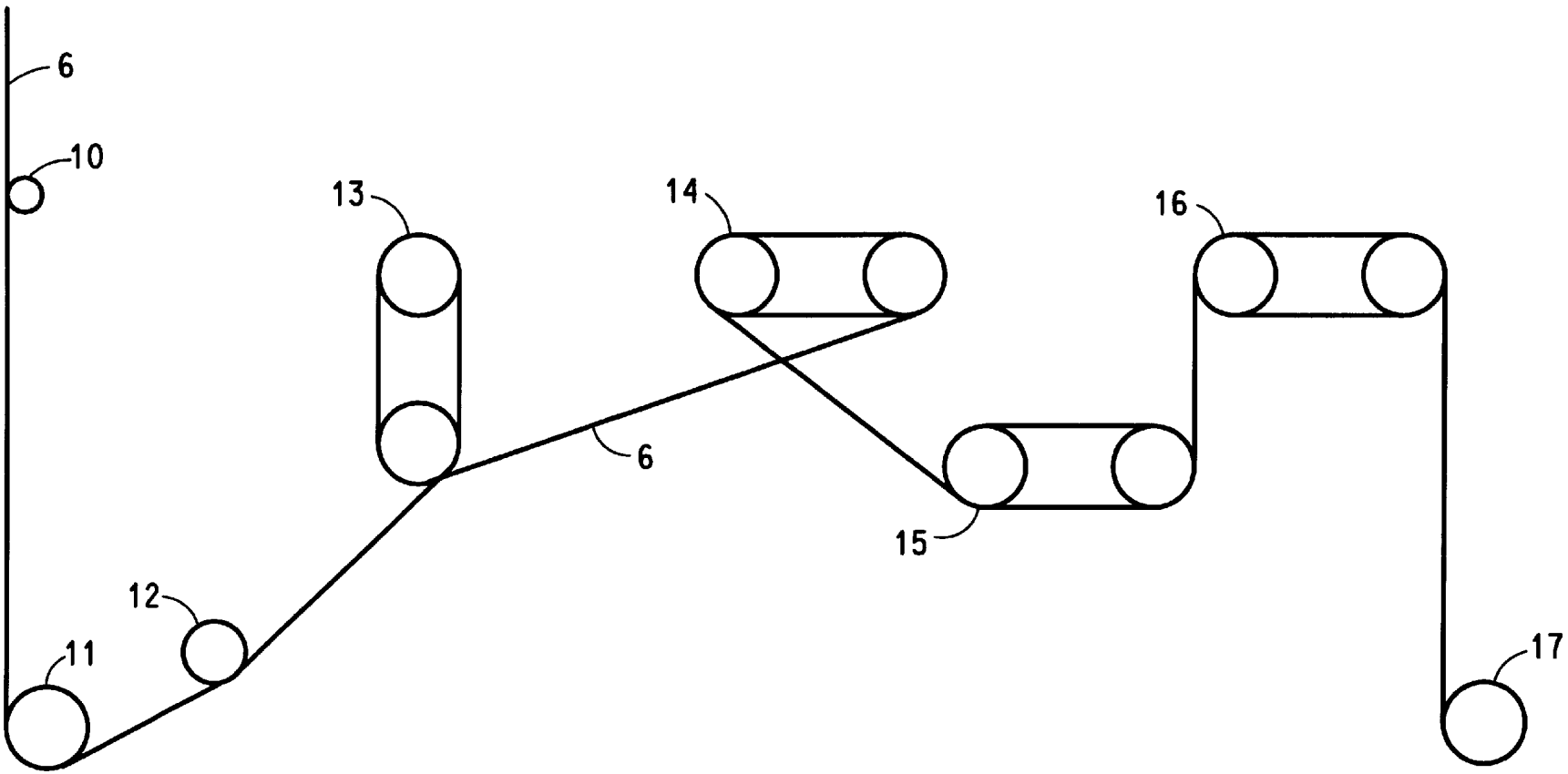
FIG. 2 illustrates an example of a roll arrangement that can be used in conjunction with the melt-spinning apparatus of FIG. 1.

In FIG. 2, fiber 6, which has just been spun for example from the apparatus shown in FIGS. 1, can be passed by (optional) finish roll 10, around driven roll 11, around idler roll 12, and then around heated feed rolls 13. The temperature of feed rolls 13 can be in the range of about 50° C. to about 70° C. The fiber can then be drawn by heated draw rolls 14. The temperature of draw rolls 14 can be in the range of about 50 to about 170° C., preferably about 100 to about 120° C. The draw ratio (the ratio of wind-up speed to withdrawal or feed roll speed) is in the range of about 1.4 to about 4.5, preferably about 3.0 to about 4.0. No significant tension (beyond that necessary to keep the fiber on the rolls) need be applied between the pair of rolls 13 or between the pair of rolls 14.

After being drawn by rolls 14, the fiber can be heat-treated by rolls 15, passed around optional unheated rolls 16 (which adjust the yarn tension for satisfactory winding), and then to windup 17. Heat treating can also be carried out with one or more other heated rolls, steam jets or a heating chamber such as a "hot chest". The heat-treatment can be carried out at substantially constant length, for example, by rolls 15 in FIG. 2, which heat the fiber to a temperature in the range of about 110° C. to about 170° C., preferably about 120° C. to about 160° C. The duration of the heat-treatment is dependent on yarn denier; what is important is that the fiber can reach substantially the same temperature as that of the rolls. If the heat-treating temperature is too low, crimp can be reduced under tension at elevated temperatures, and shrinkage can be increased. If the heat-treating temperature is too high, operability of the process becomes difficult because of frequent fiber breaks. It is preferred that the speeds of the heat-treating rolls and draw rolls be substantially equal in order to keep fiber tension substantially constant at this point in the process and thereby avoid loss of fiber crimp.

Alternatively, the feed rolls can be unheated, and drawing can be accomplished by a draw-jet and heated draw rolls which also heat-treat the fiber. An interlace jet optionally can be positioned between the draw/heat-treat rolls and windup.

Finally, the fiber is wound up. A typical wind up speed in the manufacture of the products of the present invention is 3,200 meters per minute (mpm). The range of usable wind up speeds is about 2,000 mpm to 6,000 mpm.

Figure 3:
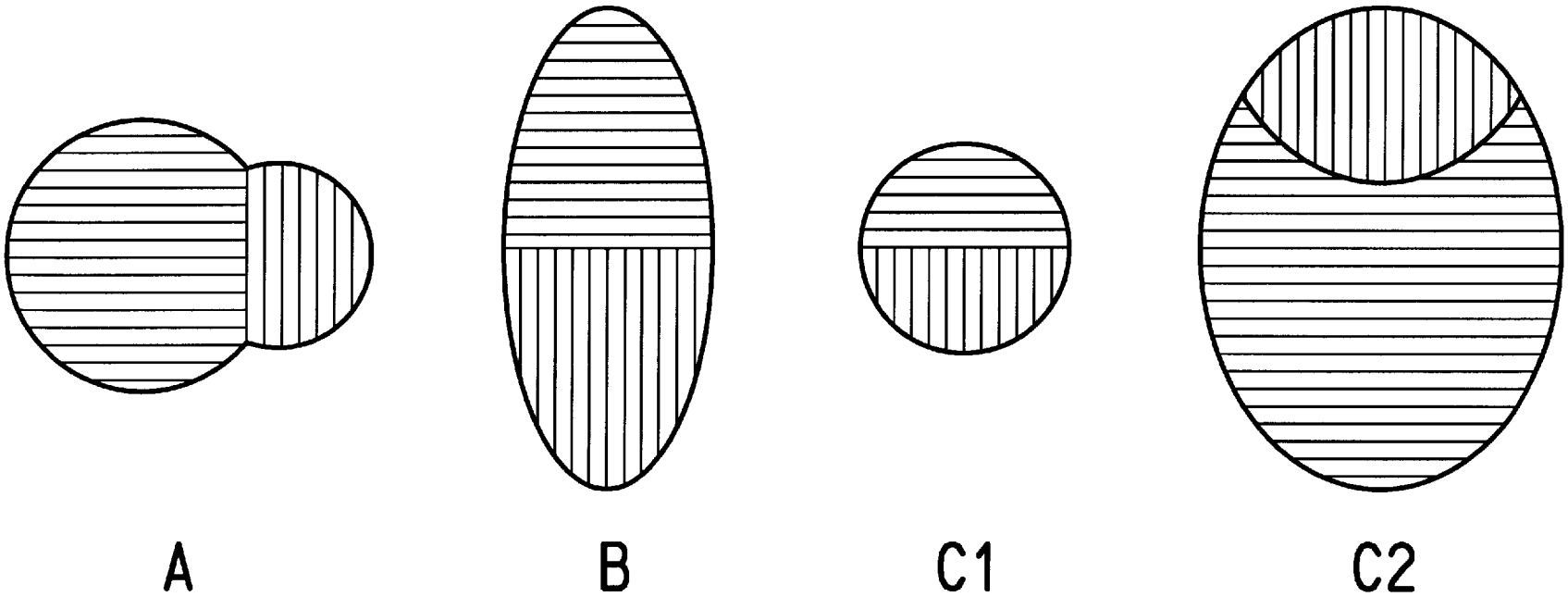
FIG. 3 illustrates examples of cross-sectional shapes that can be made by the process of the invention.

As illustrated in FIG. 3, side-by-side fibers made by the process of the invention can have a "snowman" ("A"), oval ("B"), or substantially round ("C1", "C2")cross-sectional shape. Other shapes can also be prepared. Eccentric sheath-core fibers can have an oval or substantially round cross-sectional shape. By "substantially round" it is meant that the ratio of the lengths of two axes crossing each other at 90° in the center of the fiber cross-section is no greater than about 1.2:1. By "oval" it is meant that the ratio of the lengths of two axes crossing each other at 90° in the center of the fiber cross-section is greater than about 1.2:1. A "snowman" cross-sectional shape can be described as a side-by-side cross-section having a long axis, a short axis and at least two maxima in the length of the short axis when plotted against the long axis.

One advantage of this invention is that spinning can be carried out at higher speeds when styrene polymer is present in the higher IV poly(trimethylene terephthalate) or both components. Another advantage is that spun drawn yarns can be prepared using higher draw ratios than with poly (trimethylene terephthalate) bicomponent fibers wherein a styrene polymer is not employed. One way to do this is to use a lower spin speed than normal, and then drawing at previously used speeds. When carrying out this process, there are fewer breaks than previously encountered.

Preferably, prior to spinning the composition is heated to a temperature above the melting point of each the poly (trimethylene terephthalate) and styrene polymer, and extruding the composition through a spinneret and at a temperature of about 235 to about 295° C., preferably at least about 250° C. and up to about 290° C., most preferably up to about 270° C. Higher temperatures are useful with short residence time.

Another advantage of the invention is that the draw ratio does not need to be lowered due to the use of a higher spinning speed. That is, poly(trimethylene terephthalate) orientation is normally increased when spinning speed is increased. With higher orientation, the draw ratio normally needs to be reduced. With this invention, the poly (trimethylene terephthalate) orientation is lowered as a result of using the styrene polymer, so the practitioner is not required to use a lower draw ratio.

The invention is also directed to a process for preparing poly(trimethylene terephthalate) side-by-side or eccentric sheath-core bicomponent fibers comprising (a) providing two different poly(trimethylene terephthalate)s differing in intrinsic viscosity (IV) by about 0.03 to about 0.5 dl/g, at least one of which contains (preferably about 0.1 to about 10 weight %) styrene polymer, by weight of the polymers, and (b) spinning the poly(trimethylene terephthalate)s to form side-by-side or eccentric sheath-core bicomponent fibers where at least one of the components comprises the styrene polymer dispersed throughout the poly(trimethylene terephthalate). Preferably the side-by-side or eccentric sheath-core bicomponent fibers are in the form of a partially oriented multifilament yarn.

In another preferred embodiment, the invention is directed to a process for preparing poly(trimethylene terephthalate) bicomponent self-crimping yarn comprising poly(trimethylene terephthalate) bicomponent filaments, comprising (a) preparing partially oriented poly (trimethylene terephthalate) multifilament yarn, (b) winding the partially oriented yarn on a package, (c) unwinding the yarn from the package, (d) drawing the bicomponent filament yarn to form a drawn yarn, (e) annealing the drawn yarn, and (f) winding the yarn onto a package.

In yet another preferred embodiment, the invention is directed to a process for preparing fully drawn yarn comprising crimped poly(trimethylene terephthalate) bicomponent fibers, comprising the steps of: (a) providing the two different poly(trimethylene terephthalate)s wherein at least one of them comprises styrene polymer; (b) melt-spinning the poly(trimethylene terephthalate)s from a spinneret to form at least one bicomponent fiber having either a side-by-side or eccentric sheath-core cross-section; (c) passing the fiber through a quench zone below the spinneret; (d) drawing the fiber (preferably at temperature of about 50 to about 170° C. and preferably at a draw ratio of about 1.4 to about 4.5); (e) heat-treating (e.g., annealing) the drawn fiber (preferably at about 110 to about 170° C.); (f) optionally interlacing the filaments; and (g) winding-up the filaments.

In another preferred embodiment, the process further comprises cutting the fibers into staple fibers. In one preferred embodiment, the invention is directed to a process for preparing poly(trimethylene terephthalate) self-crimped bicomponent staple fiber comprising: (a) providing the two different poly(trimethylene terephthalate)s wherein at least one of them comprises styrene polymer; (b) melt-spinning the poly(trimethylene terephthalate)s through a spinneret to form at least one bicomponent fiber having either a side-by-side or eccentric sheath-core cross-section; (c) passing the fiber through a quench zone below the spinneret; (d) optionally winding the fibers or placing them in a can; (e) drawing the fiber (preferably at a temperature of about 50 to about 170° C. and preferably at a draw ratio of about 1.4 to about 4.5); (f) heat-treating the drawn fiber (preferably at about 110 to about 170° C.); and (g) cutting the fibers into about 0.5 to about 6 inches staple fiber.

Advantages of the invention over fibers and fabrics made from poly(trimethylene terephthalate) and poly(ethylene terephthalate) include softer hand, higher dye-uptake, and the ability to dye under atmospheric pressure.

When the styrene polymer is in the higher IV poly (trimethylene terephthalate) (including when it is in both poly(trimethylene terephthalates), the fibers of this invention can be prepared using higher spinning speeds, higher drawing speeds and higher draw ratios than other poly (trimethylene terephthalate) bicomponent fibers.

When styrene polymer is added to the lower IV poly (trimethylene terephthalate) or to the lower IV poly (trimethylene terephthalate) in greater amount than the higher IV poly(trimethylene terephthalate), the differences between the molecular orientation of the poly(trimethylene terephthalate)s will increase, and crimp contraction and stretch increases.

By varying the amount of polystyrene in each side (or section), or only adding it in one side (or section), it is possible to further control the crimp level.

EXAMPLES

The following examples are presented for the purpose of illustrating the invention, and are not intended to be limiting. All parts, percentages, etc., are by weight unless otherwise indicated.

Intrinsic Viscosity

The intrinsic viscosity (IV) was determined using viscosity measured with a Viscotek Forced Flow Viscometer Y900 (Viscotek Corporation, Houston, Tex.) for the polymers dissolved in 50/50 weight % trifluoroacetic acid/methylene chloride at a 0.4 grams/dL concentration at 19° C. following an automated method based on ASTM D 5225-92. The measured viscosity was then correlated with standard viscosities in 60/40 wt % phenol/1,1,2,2-tetrachloroethane as determined by ASTM D 4603-96 to arrive at the reported intrinsic values. IV of the polymers in the fiber was determined on actually spun bicomponent fiber or, alternatively, IV of the polymers in the fiber was measured by exposing polymer to the same process conditions as polymer actually spun into bicomponent fiber except that the test polymer was spun without a pack/spinneret such that the two polymers were not combined into a single fiber.

Number Average Molecular Weight

The number average molecular weight ($M_n$) of polystyrene was calculated according to ASTM D 5296-97.

Tenacity and Elongation at Break

The physical properties of the poly(trimethylene terephthalate) yarns reported in the following examples were measured using an Instron Corp. tensile tester, model no. 1122. More specifically, elongation to break, $E_b$, and tenacity were measured according to ASTM D-2256.

Crimp Contraction

Unless otherwise noted, the crimp contraction in the bicomponent fiber made as shown in the Examples was measured as follows. Each sample was formed into a skein of 5000+/−5 total denier (5550 dtex) with a skein reel at a tension of about 0.1 gpd (0.09 dN/tex). The skein was conditioned at 70+/−° F. (21+/−1° C.) and 65+/−2% relative humidity for a minimum of 16 hours. The skein was hung substantially vertically from a stand, a 1.5 mg/den (1.35 mgl/dtex) weight (e.g. 7.5 grams for 5550 dtex skein) was hung on the bottom of the skein, the weighted skein was allowed to come to an equilibrium length, and the length of the skein was measured to within 1 mm and recorded as "Cb". The 1.35 mg/dtex weight was left on the skein for the duration of the test. Next, a 500 mg weight (100 mg/d; 90 mg/dtex) was hung from the bottom of the skein, and the length of the skein was measured within 1 mm and recorded as "Lb". Crimp contraction value (percent) (before heatsetting, as described below for this test), "CCb", was calculated according to the formula:

$$CCb=100\times(Lb-Cb)/Lb$$

The 500 g weight was removed and the skein was then hung on a rack and heatset, with the 1.35 mg/dtex weight still in place, in an oven for 5 minutes at about 212° F. (100° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "Ca". The 500-gram weight was again hung from the skein, and the skein length was measured as above and recorded as "La". The after heat-set crimp contraction value (%), "CCa", was calculated according to the formula $$CCa=100\times(La-Ca)/La$$

CCa is reported in the tables.

Poly(trimethylene terephthalate)-Polystyrene Compositions

Polymer blends were prepared from Sorona® poly (trimethylene terephthalate) having an IV of about 1.02 dl/g or poly(trimethylene terephthalate) having an IV of about 0.86 dl/g (E. I. du Pont de Nemours and Company, Wilmington, Del.) and polystyrene (BASF, Mount Olive, N.J., Grade:168 MK G2 (Melt Index (g/10 min):1.5 (ASTM 1238, 200° C./5kg), Softening Point (ASTM 01525):109° C., $M_n$ 124,000)).

Poly(trimethylene terephthalate) pellets were compounded with polystyrene using a conventional screw remelting compounder to yield a 8% blend of polystyrene in poly(trimethylene terephthalate). The poly(trimethylene terephthalate) pellets and polystyrene pellets were fed into the screw throat and vacuum was applied at the extruder throat. Blend was extruded at approximately 250° C. The extrudant flowed into a waterbath to solidify the compounded polymer into a monofilament which was then cut into pellets.

Fibers were prepared using apparatus similar to those described in FIGS. 1 and 2.

Using appropriate ratios of poly(trimethylene terephthalate) pellets and these 8% masterbatch pellets, salt and pepper blends were prepared and melted.

Fiber Preparation

Poly(ethylene terephthalate) (2GT, Crystar 4423, a registered trademark of E. I. Du Pont de Nemours and Company), having an intrinsic viscosity of 0.50 dl/g, and poly (trimethylene terephthalate), having an intrinsic viscosity of 1.02 dl/g, were spun using the apparatus of FIG. 1. The spinneret temperature was maintained at less than 265° C. The (post-coalescence) spinneret was recessed into the top of the spinning column by 4 inches (10.2 cm) ("A" in FIG. 1) so that the quench gas contacted the just-spun fibers only after a delay.

In spinning the bicomponent fibers in Examples, the polymer was melted with Werner & Pfleiderer co-rotating 28-mm extruders having 0.5–40 pound/hour (0.23–18.1 kg/hour) capacities. The highest melt temperatures attained in the poly(ethylene terephthalate) (2GT) extruder was about 280–285° C., and the corresponding temperature in the poly(trimethylene terephthalate) (3GT) extruder was about 265–275° C. Pumps transferred the polymers to the spinning head.

The fibers were wound up with a Barmag SW6 2s 600 winder (Barmag AG, Germany), having a maximum winding speed of 6000 mpm.

The spinneret used was a post-coalescence bicomponent spinneret having thirty-four pairs of capillaries arranged in a circle, an internal angle between each pair of capillaries of 30°, a capillary diameter of 0.64 mm, and a capillary length of 4.24 mm. Unless otherwise noted, the weight ratio of the two polymers in the fiber was 50/50. The quench was carried out using apparatus similar to FIG. 1. The quench gas was air, supplied at room temperature of about 20° C. The fibers had a side-by-side cross-section similar to A of FIG. 3.

In the Examples, the draw ratio applied was about the maximum operable draw ratios in obtaining bicomponent fibers. Unless otherwise indicated, rolls 13 in FIG. 2 were operated at about 70° C., rolls 14 at about 90° C. and 3200 mpm and rolls 15 at about 120° C. to about 160° C.

EXAMPLE 1

Poly(trimethylene terephthalate) /polystyrene ("PS")salt and pepper blends were prepared as described above and spun as described above. Results are shown in Table I below.

TABLE I

| Poly(trimethylene terephthalate)/Polystyrene Blend | | | | | | | | | | |
|---|---|---|---|---|---|---|---|---|---|---|
| Chip IV* | | Wt % PS | | Fiber | Draw | Rolls 15 | | Tenacity | Elongation | CCa |
| West | East | West | East | IV* | Ratio | (° C.) | Denier | (g/d) | (%) | (%) |
| 1.01 | 0.86 | 0 | 0 | 0.84 | 2.8 | 120 | 104 | 3.1 | 22 | 14.7 |
| 1.01 | 0.86 | 0.8 | 0 | 0.82 | 3.2 | 120 | 94 | 3.1 | 29 | 15.6 |
| 1.01 | 0.86 | 1.6 | 0 | 0.81 | 3.8 | 120 | 92 | 3.0 | 32 | 8.2 |
| 1.01 | 0.86 | 2.4 | 0 | 0.81 | 4.3 | 120 | 99 | 3.8 | 30 | 5.5 |
| 1.01 | 0.86 | 0 | 0.8 | 0.82 | 2.6 | 120 | 103 | 3.0 | 20 | 29.9 |

*As measured, dl/g.

The data shows that when polystyrene was added to the West extruder drawability is greatly improved as shown by higher draw ratios. This is attributed to lower orientation on the West side of the bicomponent which enables higher draw ratio. It also means that spinning speed can be increased drastically to improve bicomponent spinning productivity. When polystyrene is added to the East extruder crimp contraction (CCa) is greatly improved. This is attributed to further lowering the orientation on the low IV side of the bicomponent fiber which further increases the orientation delta between the two sides of the bicomponent and hence increases the crimp contraction.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the disclosure.

What is claimed is:

1. A side-by-side or eccentric sheath-core bicomponent fiber wherein each component comprises poly(trimethylene terephthalate) differing in intrinsic viscosity (IV) by about 0.03 to about 0.5 dl/g and wherein at least one of the components comprises styrene polymer dispersed throughout the poly(trimethylene terephthalate).

2. The side-by-side or eccentric sheath-core bicomponent fiber of claim 1 wherein the poly(trimethylene terephthalate) differ in IV by at least about 0.10 dl/g.

3. The side-by-side or eccentric sheath-core bicomponent fiber of claim 1 wherein the poly(trimethylene terephthalate) differ in IV by up to about 0.3 dl/g.

4. The side-by-side or eccentric sheath-core bicomponent fiber of claim 2 wherein the poly(trimethylene terephthalate) differ in IV by up to about 0.3 dl/g.

5. The side-by-side or eccentric sheath-core bicomponent fiber of claim 1 wherein the styrene polymer is selected from the group consisting of polystyrene, alkyl or aryl substituted polystyrenes and styrene multicomponent polymers.

6. The side-by-side or eccentric sheath-core bicomponent fiber of claim 1 wherein the styrene polymer is polystyrene.

7. The side-by-side or eccentric sheath-core bicomponent fiber of claim 1 wherein the styrene polymer is present in at least one of the components in the range of about 0.1 to about 10 weight %, by weight of the polymers in the component.

8. The side-by-side or eccentric sheath-core bicomponent fiber of claim 1 wherein the styrene polymer is present in at least one of the components in the range of about 0.5 to about 5 weight %, by weight of the polymers in the component.

9. The side-by-side or eccentric sheath-core bicomponent fiber of claim 1 wherein the styrene polymer is present in at least one of the components in the range of about 0.5 to about 2 weight %, by weight of the polymers in the component.

10. The side-by-side or eccentric sheath-core bicomponent fiber of claim 1 wherein the styrene polymer is present in each of the components.

11. The side-by-side or eccentric sheath-core bicomponent fiber of claim 1 wherein the styrene polymer is present in only one of the components.

12. The side-by-side or eccentric sheath-core bicomponent fiber of claim 11 wherein the styrene polymer is in the component with the higher IV poly(trimethylene terephthalate).

13. The side-by-side or eccentric sheath-core bicomponent fiber of claim 11 wherein the styrene polymer is in the component with the lower IV poly(trimethylene terephthalate).

14. The side-by-side or eccentric sheath-core bicomponent fiber of claim 8 wherein each component comprises at least about 95% of poly(trimethylene terephthalate), by weight of the polymer in the component, and each of the poly(trimethylene terephthalate)s contains at least 95 mole % trimethylene terephthalate repeat units.

* * * * *